US009757951B2

(12) United States Patent
Osakabe et al.

(10) Patent No.: US 9,757,951 B2
(45) Date of Patent: Sep. 12, 2017

(54) LIQUID-CONSUMING APPARATUS

(71) Applicant: BROTHER KOGYO KABUSHIKI KAISHA, Nagoya-shi, Aichi-ken (JP)

(72) Inventors: Yoshinori Osakabe, Seto (JP); Tomohisa Higuchi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/449,294

(22) Filed: Mar. 3, 2017

(65) Prior Publication Data

US 2017/0173968 A1 Jun. 22, 2017

Related U.S. Application Data

(63) Continuation of application No. 14/854,100, filed on Sep. 15, 2015, now Pat. No. 9,586,409.

(30) Foreign Application Priority Data

Oct. 31, 2014 (JP) ..... 2014-222268

(51) Int. Cl.
*B41J 2/175* (2006.01)

(52) U.S. Cl.
CPC ..... *B41J 2/17553* (2013.01); *B41J 2/17523* (2013.01)

(58) Field of Classification Search
CPC .. B41J 2/1752; B41J 2/17513; B41J 2/17509; B41J 2/17523; B41J 2/17553; B41J 2/17566; B41J 29/13; B41J 2002/17573
See application file for complete search history.

(56) References Cited

U.S. PATENT DOCUMENTS

| | | | |
|---|---|---|---|
| 2,687,157 | A | 8/1954 | Cowan |
| 5,005,740 | A | 4/1991 | Marks |
| 5,467,118 | A | 11/1995 | Gragg |
| 5,821,967 | A | 10/1998 | Solero |
| 2005/0185034 | A1 | 8/2005 | Amma |
| 2006/0082625 | A1 | 4/2006 | Kotaki |
| 2006/0087538 | A1 | 4/2006 | Amma |
| 2006/0290722 | A1 | 12/2006 | Kitagawa |
| 2008/0024571 | A1 | 1/2008 | Nip |
| 2011/0234716 | A1 | 9/2011 | Kubo |
| 2014/0104349 | A1 | 4/2014 | Kimura et al. |

FOREIGN PATENT DOCUMENTS

JP 2014-79909 A 5/2014

*Primary Examiner* — Huan Tran
*Assistant Examiner* — Alexander D Shenderov
(74) *Attorney, Agent, or Firm* — Merchant & Gould P.C.

(57) ABSTRACT

A liquid-consuming apparatus includes: a tank including a liquid chamber, an upstanding wall facing a particular direction, and an inlet formed in a surface of the tank; a liquid-consuming unit consuming liquid stored in the liquid chamber; a cover rotatable between a covering position where the upstanding wall is covered with the cover and an exposure position where the upstanding wall is exposed, around a rotation axis extending in a further direction; and a casing including an engaging target part which holds the cover in the covering position, and supporting the tank, liquid-consuming unit, and cover. The cover includes: an engaging part to engage with the engaging target part in the state that the cover is in the covering position; and a tab which is subjected to an operation for releasing an engagement between the engaging part and the engaging target part.

11 Claims, 10 Drawing Sheets

LIQUID-CONSUMING APPARATUS

CROSS REFERENCE TO RELATED APPLICATION

The present application is a continuation of U.S. patent application Ser. No. 14/854,100, filed Sep. 15, 2015, which further claims priority from Japanese Patent Application No. 2014-222268, filed on Oct. 31, 2014, the disclosure of both of which are incorporated herein by reference in their entirety.

BACKGROUND

Field of the Invention

The present teaching relates to a liquid-consuming apparatus having a tank which can be replenished with liquid through an inlet.

Description of the Related Art

There is conventionally known a liquid-consuming apparatus including a tank and a liquid-consuming unit. The tank can be replenished with liquid through an inlet. The liquid-consuming unit consumes the liquid stored in the tank. Further, there is known a recording apparatus including a cover, which is rotatable between a covering position where an ink tank is covered with the cover and an exposure position where an inlet provided in the ink tank is exposed. This cover includes a transparent portion for allowing a user to visually confirm a remaining amount of ink in the ink tank in a state that the cover is in the covering position.

Regarding the above recording apparatus, the user is capable of visually confirming a remaining amount of ink in the ink tank through the transparent portion with the cover being in the covering position. When the user has noticed that the amount of ink in the ink tank is insufficient, the user is capable of refilling the ink tank with the ink through the inlet, after rotating the cover to the exposure position.

SUMMARY

The above recording apparatus, however, is required that the cover has an opening in order to form the transparent portion. This reduces the rigidity of the cover. As a result, there is fear that the cover might be twisted by the force to rotate the cover so that the cover might not rotate smoothly.

The present teaching has been made in view of the abovementioned circumstances, and an object of the present teaching is to provide a liquid-consuming apparatus in which a cover having an opening is smoothly rotatable.

According to an aspect of the present teaching, there is provided a liquid-consuming apparatus, including: a tank including a liquid chamber, an upstanding wall facing a particular direction, and an inlet formed in a surface of the tank, the upstanding wall defining the liquid chamber and being configured to allow liquid in the liquid chamber to be visually confirmed from an outside; a liquid-consuming unit configured to consume the liquid stored in the liquid chamber; a cover configured to rotate between a covering position where the upstanding wall is covered with the cover and an exposure position where the upstanding wall is exposed, around a rotation axis extending in a further direction; and a casing including an engaging target part and configured to support the tank, the liquid-consuming unit, and the cover, the engaging target part being configured to hold the cover in the covering position, wherein the cover includes an engaging part and a tab, the engaging part being configured to engage with the engaging target part in a state that the cover is in the covering position, the tab being subjected to an operation of releasing an engagement between the engaging part and the engaging target part, and the engaging part and the tab are arranged to intersect with an identical virtual plane orthogonal to the further direction.

According to the liquid-consuming apparatus having the above structure, it is possible to reduce the twisting of the cover caused by the force applied to the tab by a user. Thus, the cover can rotate smoothly between the covering position and the exposure position.

BRIEF DESCRIPTION OF THE DRAWINGS

FIGS. 1A and 1B are perspective views of outer appearances of a multifunction peripheral, wherein FIG. 1A depicts a state that a cover is closed, and FIG. 1B depicts a state that the cover is open.

FIGS. 10A and 10B are plan views of the cover in the covering position, wherein FIG. 10A depicts a configuration in which an engaging part partially overlaps with a tab in a first axis direction, and FIG. 10B depicts a configuration in which the entire engaging part overlaps with a part of the tab in the first axis direction.

DESCRIPTION OF THE EMBODIMENTS

Figure 1A:
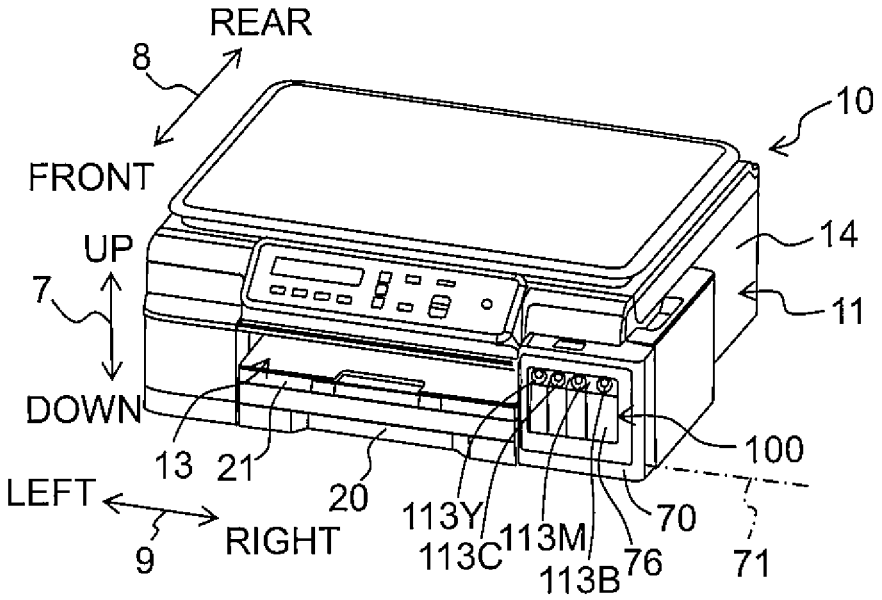

In the following, an explanation will be made about an embodiment of the present teaching. It is needless to say that the embodiment to be explained below is merely an example of the present teaching, and it is possible to appropriately change the embodiment of the present teaching without departing from the gist and scope of the present teaching. In the following explanation, an up-down direction 7 includes upward and downward directions as components thereof, and the upward direction is oriented against the downward direction. A left-right direction 9 includes leftward and rightward directions as components thereof, and the leftward direction is oriented against the rightward direction. A front-rear direction 8 includes frontward and rearward directions as components thereof, and the frontward direction is oriented against the rearward direction. In this embodiment, the up-down direction 7 corresponds to a vertical direction and the front-rear direction 8 and the left-right direction 9 correspond to a horizontal direction.

Further, the state in which a multifunction peripheral 10 is placed to be usable (the state depicted in FIGS. 1A and 1B) is described as "usable state". The posture in which the multifunction peripheral 10 is placed to be usable (the posture depicted in FIGS. 1A and 1B) is described as "usable posture". The up-down direction 7 is defined on the basis of the usable state or usable posture. The front-rear direction 8 is defined as an opening 13 of the multifunction peripheral 10 is provided on the near side (the front side). The left-right direction 9 is defined as the multifunction peripheral 10 is viewed from the near side (the front side). A direction from the rear side to the front side is an exemplary particular direction and a direction from the front side to the rear side is an exemplary opposite direction. The left-right direction 9 is an exemplary further direction.

<Entire Structure of Multifunction Peripheral 10>

Figure 1B:
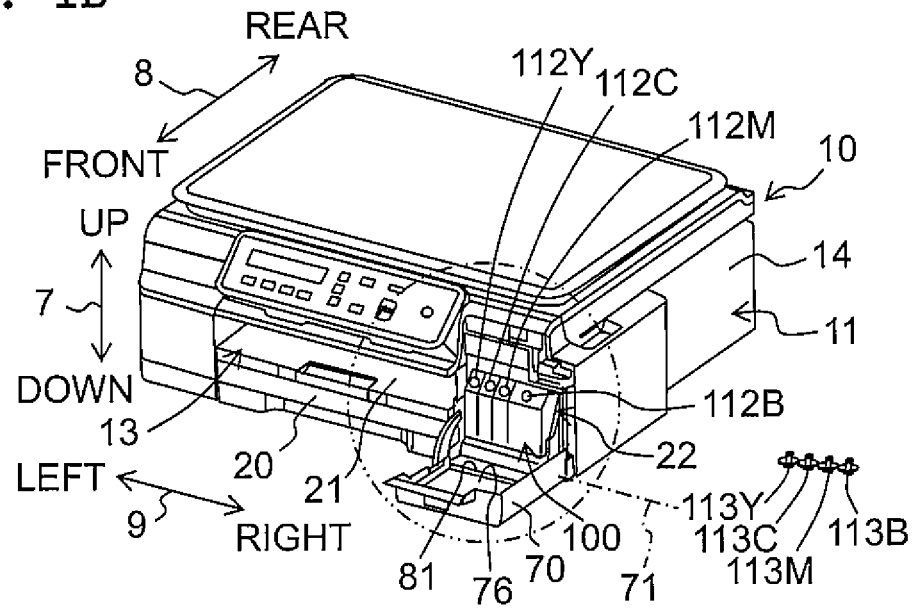
Figure 3:
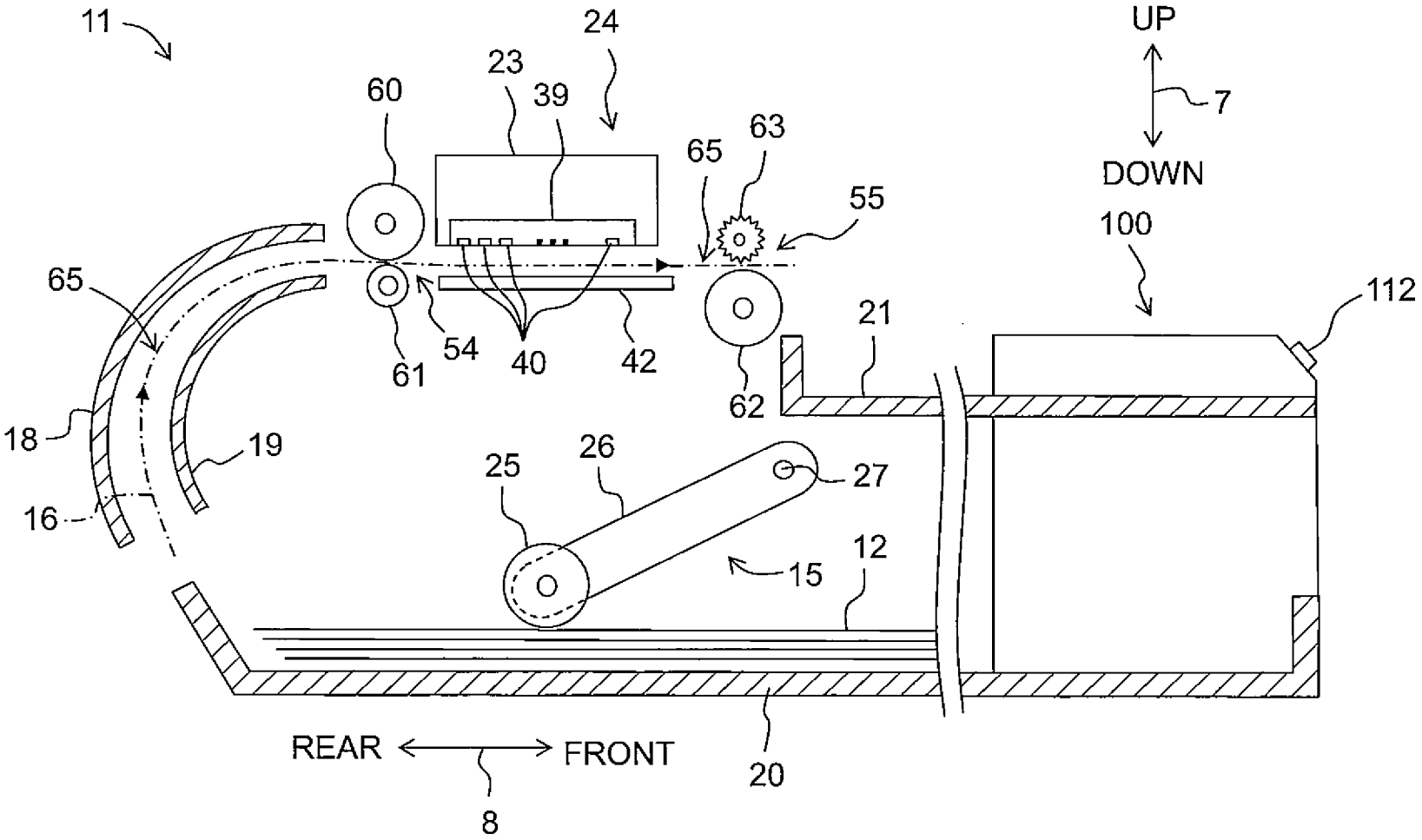
FIG. 3 is a vertical cross-sectional view schematically depicting the internal structure of a printer unit.

As depicted in FIGS. 1A and 1B, the multifunction peripheral 10 is formed to have an approximately cuboid form. A printer unit 11 of the ink-jet recording system is provided at a lower part of a casing 14 of the multifunction peripheral 10 to record an image on a sheet 12 (see FIG. 3). The casing 14 includes an exterior member and a frame. The exterior member is configured as the outer appearance of the multifunction peripheral 10 by covering a conveyance roller unit 54, a discharge roller unit 55, a recording unit 24, and the like which will be described later. The frame is surrounded with the exterior member and is formed as the framework of the multifunction peripheral 10. As depicted in FIG. 3, the printer unit 11 includes a feed unit 15, a feed tray 20, a discharge tray 21, the conveyance roller unit 54, the recording unit 24, the discharge roller unit 55, a platen 42, and an ink tank 100 (an exemplary tank). The multifunction peripheral 10 includes various functions such as a facsimile function and a print function. The multifunction peripheral 10 is an exemplary liquid-consuming apparatus.

<Feed Tray 20, Discharge Tray 21>

As depicted in FIGS. 1A and 1B, the opening 13 is formed at the central part in the left-right direction 9 of the front surface of the multifunction peripheral 10. The feed tray 20 is inserted to and pulled or drawn out of the multifunction peripheral 10 by a user in the front-rear direction 8 via the opening 13. The feed tray 20 can support sheets 12 stacked thereon. The discharge tray 21 is disposed above the feed tray 20, and the discharge tray 21 is inserted to and pulled or drawn out of the multifunction peripheral 10 together with the feed tray 20. The discharge tray 21 supports each sheet 12 which is discharged by the discharge roller unit 55 from the space between the recording unit 24 and the platen 42.

<Feed Unit 15>

The feed unit 15 feeds each sheet 12 supported by the feed tray 20 to a conveyance path 65. As depicted in FIG. 3, the feed unit 15 includes a feed roller 25, a feed arm 26, and a shaft 27. The feed roller 25 is rotatably supported on the side of the forward end of the feed arm 26. The reverse rotation of a conveyance motor (not depicted) rotates the feed roller 25 in the direction in which the sheet 12 is conveyed in a conveyance direction 16. In the following, the rotations of the feed roller 25, a conveyance roller 60, and a discharge roller 62 in the direction in which the sheet 12 is conveyed in the conveyance direction 16 are described as "forward (normal) rotation". The feed arm 26 is swingably supported by the shaft 27 which is supported by a frame of the printer unit 11. The feed arm 26 is biased to swing toward the feed tray 20 by self-weight or the elastic force of a spring or the like.

<Conveyance Path 65>

Figure 4:
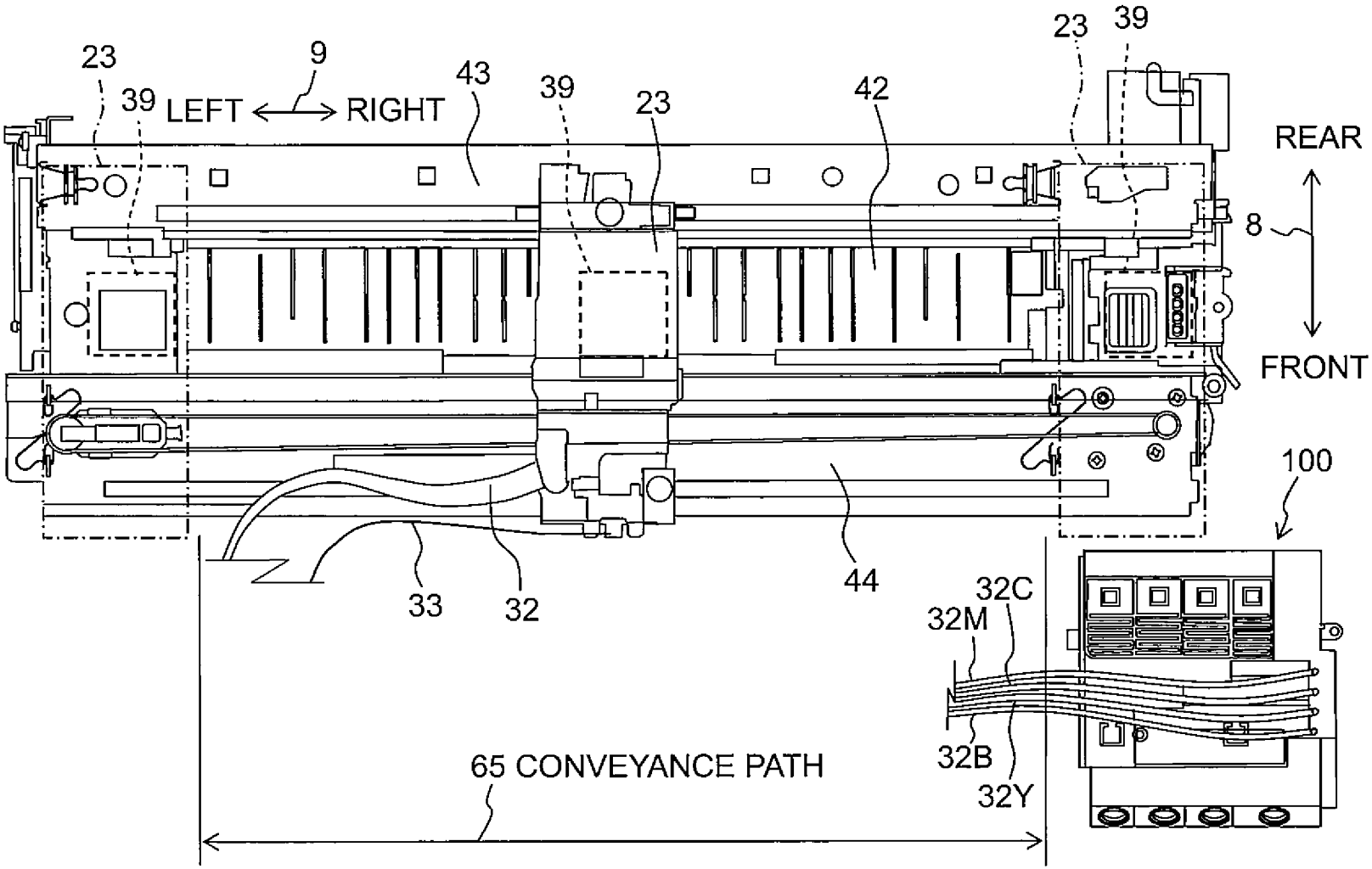
FIG. 4 is a plan view depicting the arrangement of a carriage and an ink tank.

As depicted in FIG. 3, the conveyance path 65 is a path which extends from the rear end of the feed tray 20 toward the rear side of the printer unit 11, extends from the lower side to the upper side in the up-down direction 7 on the rear side of the printer unit 11 while being curved to make a U-turn, and passes through the space between the recording unit 24 and the platen 42 to arrive at the discharge tray 21. A part of the conveyance path 65 is formed by an outer guide member 18 and an inner guide member 19 facing each other while being separated by a predetermined interval in the printer unit 11. Further, as depicted in FIGS. 3 and 4, a part of the conveyance path 65, which is positioned between the conveyance roller unit 54 and the discharge roller unit 55 in the front-rear direction 8, is substantially in the center of the multifunction peripheral 10 in the left-right direction 9 to extend in the front-rear direction 8. The conveyance direction 16 of the sheet 12 in the conveyance path 65 is depicted by arrows indicated by dashed-dotted lines in FIG. 3.

<Conveyance Roller Unit 54>

As depicted in FIG. 3, the conveyance roller unit 54 is disposed on the upstream side of the recording unit 24 in the conveyance direction 16. The conveyance roller unit 54 includes the conveyance roller 60 and a pinch roller 61 facing each other. The conveyance roller 60 is driven by the conveyance motor. The pinch roller 61 rotates accompanying with the rotation of the conveyance roller 60. The sheet 12 is conveyed in the conveyance direction 16 while being held or nipped by the conveyance roller 60 and the pinch roller 61 which rotate in the forward direction due to the forward rotation of the conveyance motor.

<Discharge Roller Unit 55>

As depicted in FIG. 3, the discharge roller unit 55 is disposed on the downstream side of the recording unit 24 in the conveyance direction 16. The discharge roller unit 55 includes the discharge roller 62 and a spur roller 63 facing each other. The discharge roller 62 is driven by the conveyance motor. The spur roller 63 rotates accompanying with the rotation of the discharge roller 62. The sheet 12 is conveyed in the conveyance direction 16 while being held or nipped by the discharge roller 62 and the spur roller 63 which rotate in the forward direction due to the forward rotation of the conveyance motor.

<Recording Unit 24>

As depicted in FIG. 3, the recording unit 24 is disposed between the conveyance roller unit 54 and the discharge roller unit 55 in the conveyance direction 16. Further, the recording unit 24 is disposed to face the platen 42 in the up-down direction 7 with the conveyance path 65 intervening therebetween. That is, the recording unit 24 is disposed above the conveyance path 65 in the up-down direction 7 to face the conveyance path 65. The recording unit 24 includes a carriage 23 and a recording head 39 (an exemplary liquid-consuming unit).

As depicted in FIG. 4, the carriage 23 is supported by guide rails 43, 44 which extend in the left-right direction 9 in a state of being separated in the front-rear direction 8. The guide rails 43, 44 are supported by the frame of the printer unit 11. The carriage 23 is connected to a known belt mechanism provided for the guide rail 44. The belt mechanism is driven by a carriage motor (not depicted). That is, the carriage 23 connected to the belt mechanism reciprocates in the left-right direction 9 by the drive of the carriage motor. The carriage 23 moves leftward and rightward beyond the conveyance path 65 in the left-right direction 9 as depicted by dashed-dotted lines in FIG. 4.

Ink tubes 32 and a flexible flat cable 33 are extended out from the carriage 23. The ink tubes 32 connect the ink tank 100 and the recording head 39, and the flexible flat cable 33 electrically connects the recording head 39 and a control board mounting a controller (not depicted). The inks stored in the ink tank 100 are supplied to the recording head 39 through the ink tubes 32. More specifically, four ink tubes 32B, 32M, 32C, and 32Y, through which black, magenta, cyan, and yellow inks pass respectively, are extended out from the ink tank 100 and are connected to the carriage 23 in a state of being mutually bound. The four ink tubes 32B, 32M, 32C, and 32Y will be described collectively as "ink tubes 32" in some cases. A control signal to be outputted from the controller is transmitted to the recording head 39 via the flexible flat cable 33.

As depicted in FIG. 3, the recording head 39 is carried on the carriage 23. Nozzles 40 are formed on the lower surface of the recording head 39. The tip portions of the nozzles 40 are exposed from the lower surfaces of the recording head 39 and the carriage 23 carrying the recording head 39. In the following, the surface from which the tip portions of the nozzles 40 are exposed will be described as "nozzle surface" in some cases. The recording head 39 discharges the ink(s) from the nozzles 40 as minute ink droplets. The recording head 39 discharges the ink droplets onto a sheet 12 supported by the platen 42 during the movement of the carriage 23. Accordingly, an image is recorded on the sheet 12.

<Platen 42>

As depicted in FIGS. 3 and 4, the platen 42 is disposed between the conveyance roller unit 54 and the discharge roller unit 55 in the conveyance direction 16. The platen 42 is disposed to face the recording unit 24 in the up-down direction 7 so as to support the sheet 12 conveyed by the conveyance roller unit 54 from the lower side of the sheet 12.

<Ink Tank 100>

As depicted in FIGS. 1A and 1B, the ink tank 100 is accommodated in the multifunction peripheral 10. The ink tank 100 is fixed to the casing 14 of the multifunction peripheral 10 so as not to be removed from the multifunction peripheral 10 easily. That is, the ink tank 100 is supported by the casing 14. More specifically, the ink tank 100 is accommodated in the multifunction peripheral 10 through the opening 22 formed in the front surface of the casing 14 at the right end in the left-right direction 9. The opening 22 is adjacent to the opening 13 in the left-right direction 9. The front surface of the ink tank 100 (parts of a base wall 101A and an inclined wall 101B which will be described later) is positioned on the front side of the opening 22 in the front-rear direction 8. More specifically, the front surface of the ink tank 100 is positioned on the front side of a front wall 14A (see FIG. 9), of the casing 14, defining the opening 22.

Figure 2A:
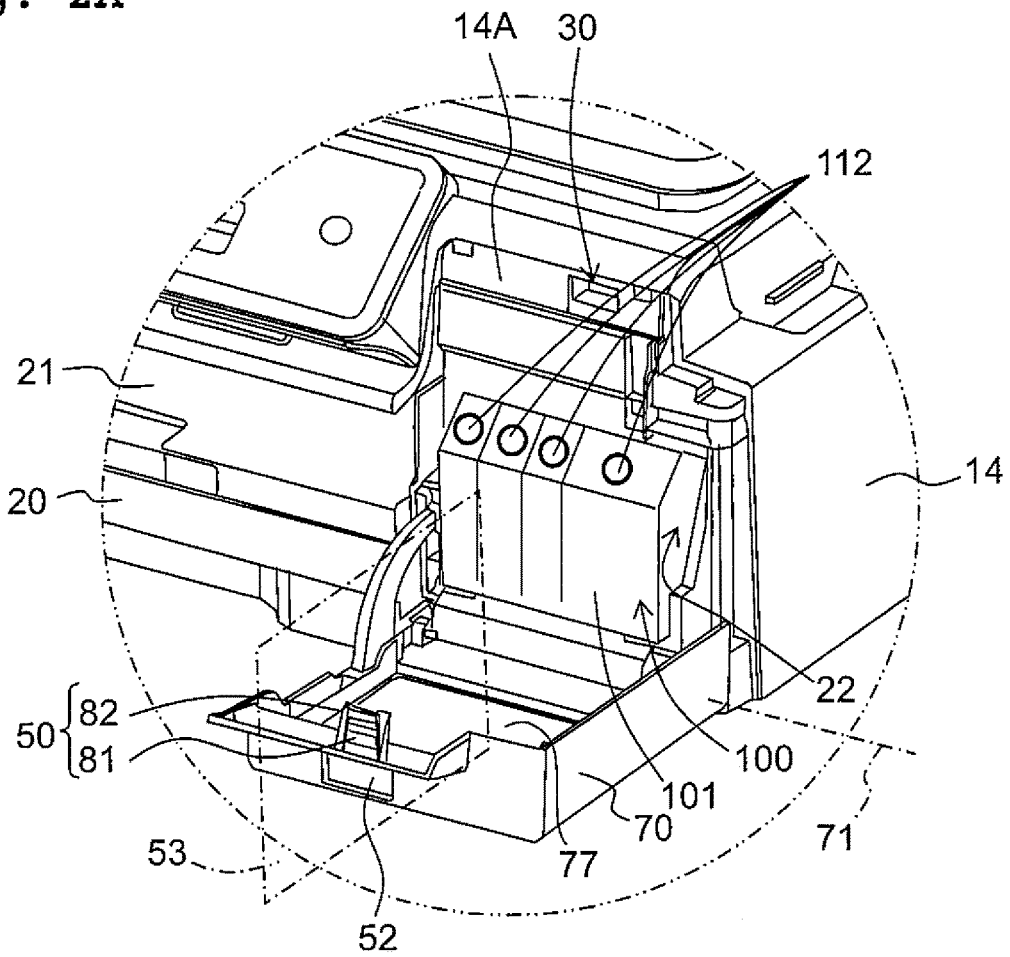
FIG. 2A is an enlarged view of an area around the cover surrounded by the circle depicted in FIG. 1B.

As depicted in FIG. 2A, a recess 30 (an exemplary engaging target part) is formed in the front surface of the casing 14, above the opening 22. The recess 30 is recessed rearward from the front surface of the casing 14. The recess 30 can receive an engaging part 50 of a cover 70 which will be described later.

Figure 7B:
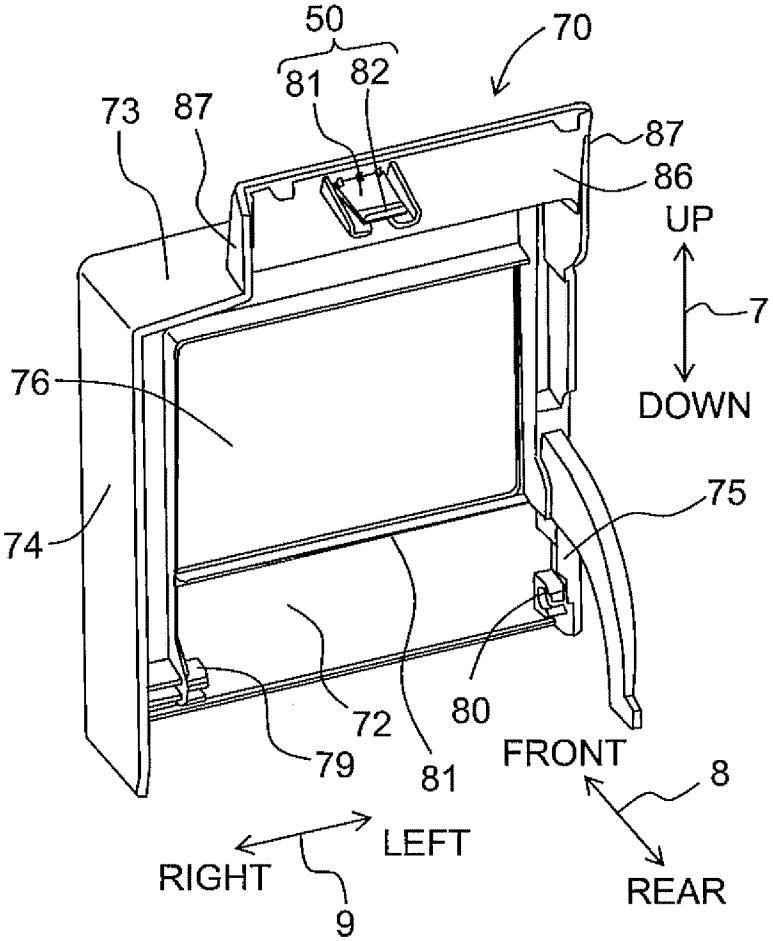
FIG. 7B is a perspective view of the cover as viewed from the inner surface side of the main wall.
Figure 7A:
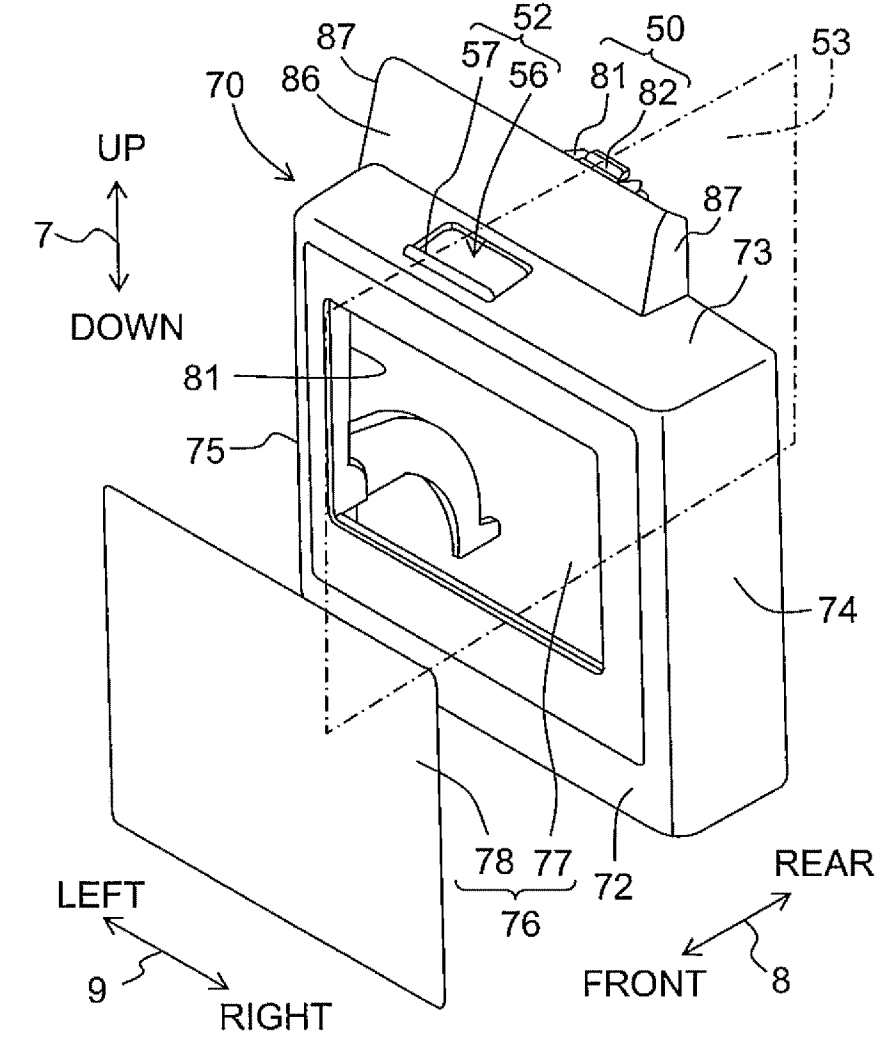
FIG. 7A is a perspective view of the cover as viewed from the outer surface side of a main wall.

The multifunction peripheral 10 includes the box-shaped cover 70 which is capable of covering the front surface of the ink tank 100 positioned on the front side of the opening 22. As depicted in FIGS. 7A and 7B, the cover 70 includes a main wall 72, side walls 73, 74, and 75, and a protruding wall 86. The main wall 72 has a substantially rectangular shape. The side walls 73, 74, and 75 protrude from the outer periphery of the main wall 72 in the thickness direction of the main wall 72. The protruding wall 86 protrudes, in the direction opposite to the side of a rotation axis 71, from the side wall 73 of the cover 70 on the pivot front-end side. The cover 70 is made mainly of resin.

Figure 2B:
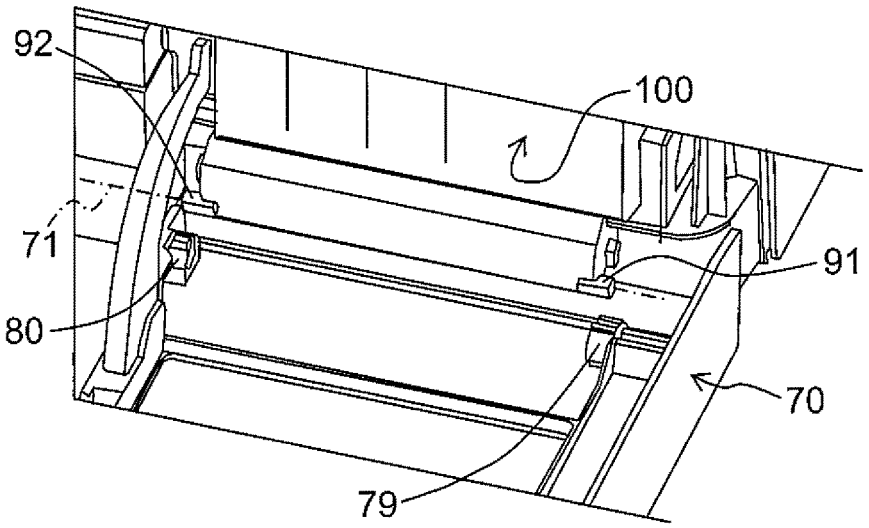
FIG. 2B is an exploded perspective view of an area around a rotation axis of the cover.

The side wall 74 includes a bearing 79 at an end of the cover 70 on the pivot base-end side. Similarly, the side wall 75 includes a bearing 80 at an end of the cover 70 on the pivot base-end side. The bearings 79, 80 are disposed on the rotation axis 71 in a state that the cover 70 is attached to the casing 14. As depicted in FIG. 2B, support shafts 91, 92 are provided as a pair in the casing 14. The support shafts 91, 92 are disposed on a lower side of the opening 22 to extend, on the rotation axis 71, in a direction away from each other. The bearings 79, 80 receive the support shafts 91, 92 respectively in a state that the cover 70 is attached to the casing 14. This allows the cover 70 to rotate or pivot, relative to the casing 14, around the rotation axis 71.

The cover 70 is supported by the casing 14 of the multifunction peripheral 10 to be rotatable between a covering position depicted in FIG. 1A and an exposure position depicted in FIG. 1B. The covering position is a position where the opening 22 and the front wall 101 of the ink tank 100 are covered with the cover 70 from the front side. In other words, the covering position is a position where the opening 22 and the front wall 101 of the ink tank 100 are covered with the cover 70 in the front-rear direction 8. The exposure position is a position where the opening 22 and the front wall 101 of the ink tank 100 are exposed to the outside of the multifunction peripheral 10. The upper surface of the cover 70 in the covering position is substantially horizontal or downwardly inclined toward the front side.

Figure 8:
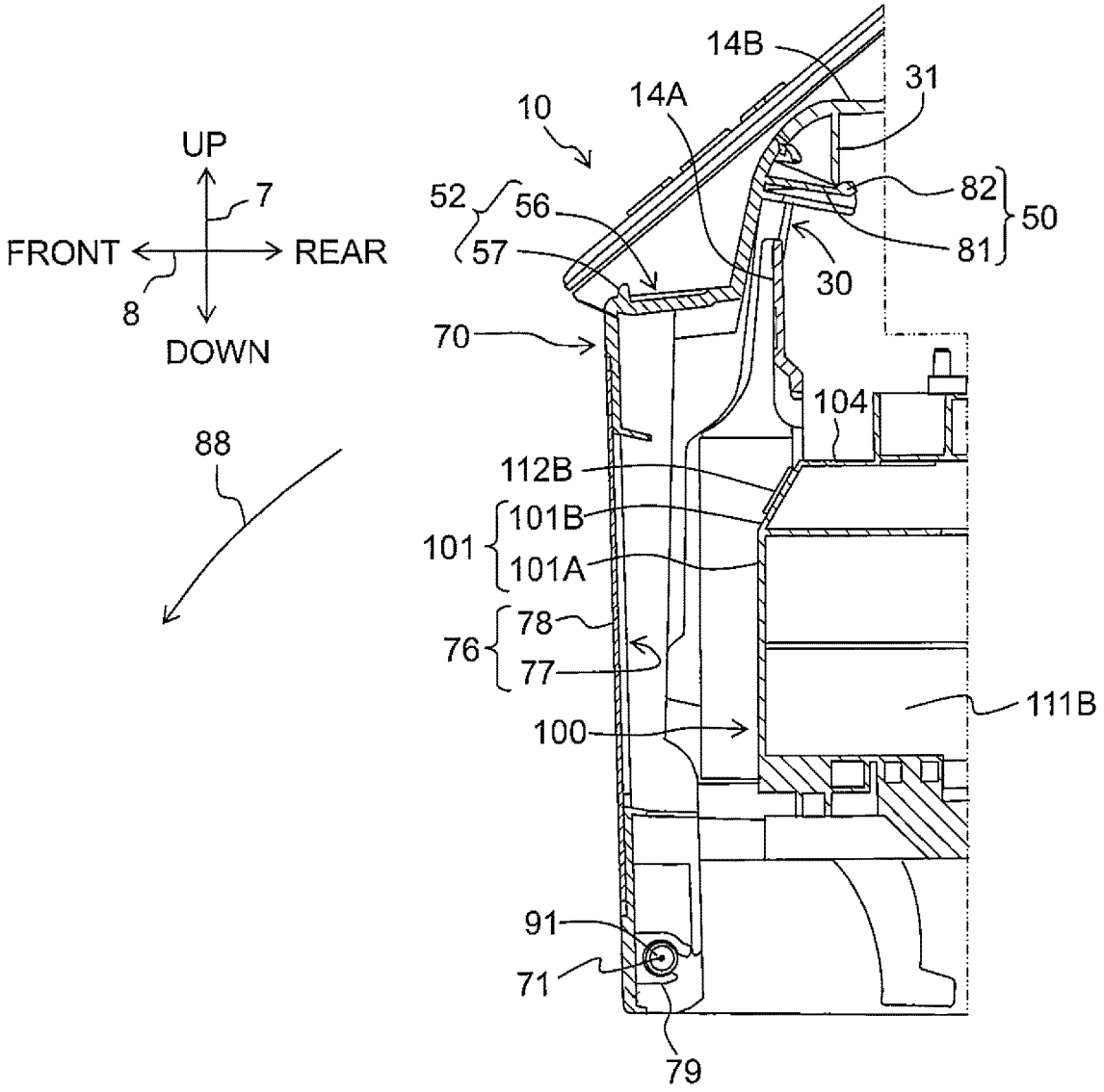
FIG. 8 is a vertical cross-sectional view of the ink tank and the cover in a covering position.

As depicted in FIGS. 1A, 1B, and 8, the cover 70 is supported by the casing 14 of the multifunction peripheral 10 to be rotatable around the rotation axis 71, which extends in the left-right direction 9 intersecting with the up-down direction 7 as a vertical direction. In this embodiment, the rotation axis 71 is positioned on the front side of the front wall 101 in the front-rear direction 8 (i.e., the side opposite to the ink chambers 111 with reference to the front wall 101). Further, the rotation axis 71 is positioned below the ink tank 100 in the up-down direction 7. Particularly, the rotation axis 71 is positioned at a lower end, of the cover 70 in the covering position, in the up-down direction 7. The rotation axis 71, however, may be in any position provided that the rotation axis 71 is positioned below at least inlets 112. That is, the position of the rotation axis 71 is not limited to the lower end, of the cover 70 in the covering position, in the up-down direction 7. Regarding the ink tank 100 and the rotation axis 71, the above positional relation is required to be satisfied when the ink tank 100 is in the posture for allowing the ink to be poured into the ink chamber 111 through the inlet 112 (the posture for pouring ink).

Figure 5:
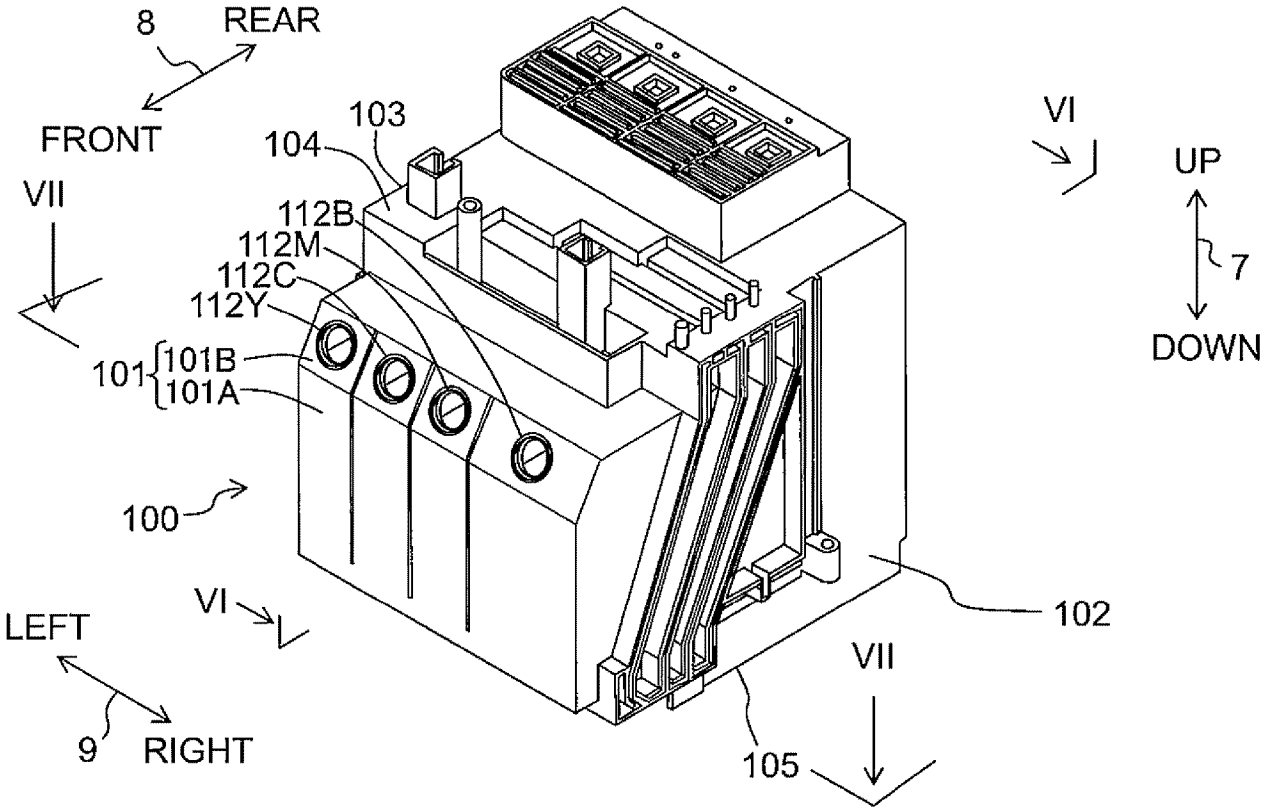
FIG. 5 is a perspective view of the ink tank as viewed from the front side.
Figure 6:
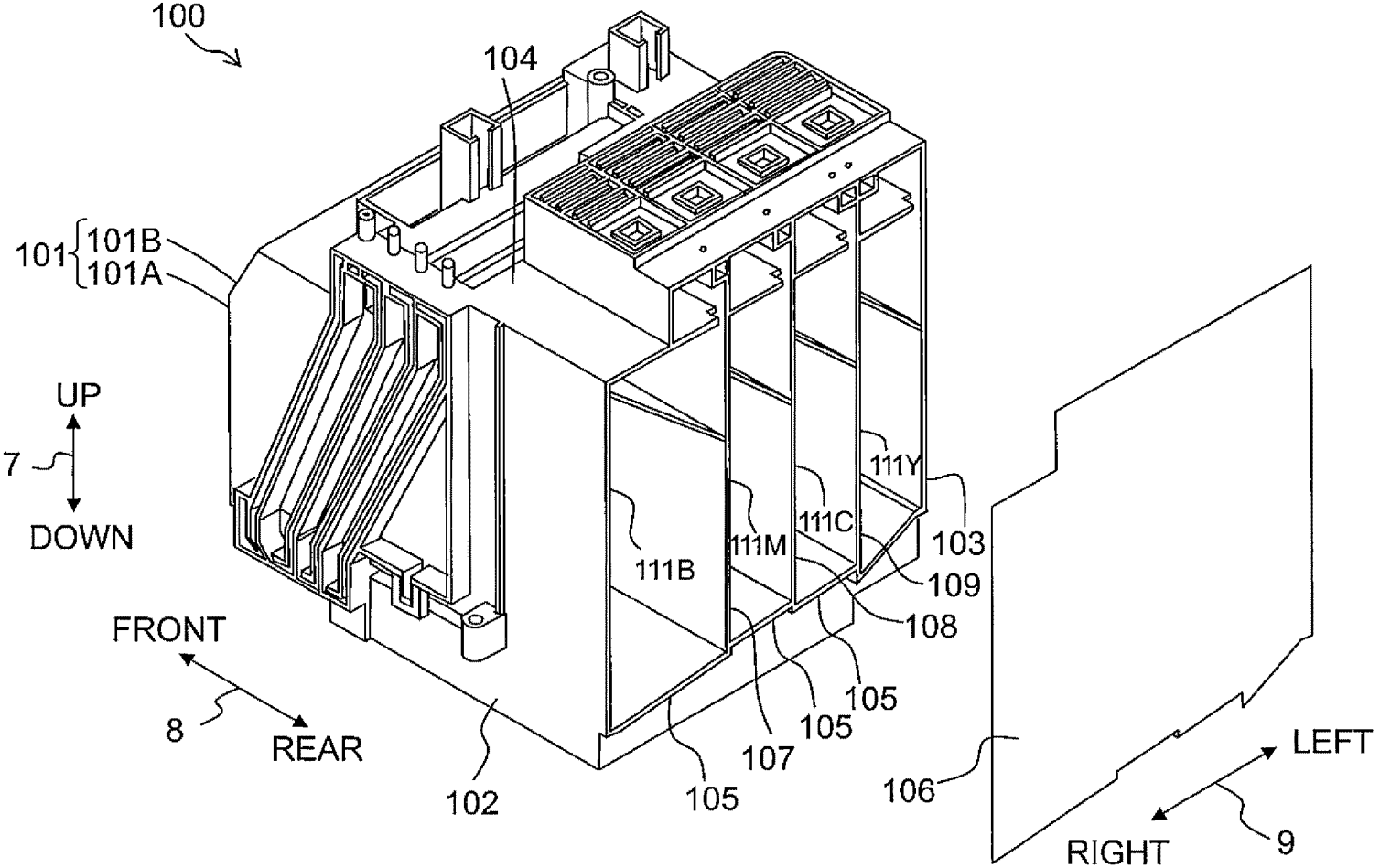
FIG. 6 is a perspective view of the ink tank as viewed from the rear side.

As depicted in FIGS. 5 and 6, the ink tank 100 has a substantially rectangular parallelepiped shape. The ink tank 100 includes a front wall 101, a right wall 102, a left wall 103, an upper wall 104, and a lower wall 105. The rear surface of the ink tank 100 is open. The rear surface of the ink tank 100 is sealed by welding a film 106 to the rear end surfaces of the right wall 102, the left wall 103, the upper wall 104, and the lower wall 105. That is, the film 106 constitutes the rear wall of the ink tank 100. The ink tank 100 having the above structure is integrally molded by performing, for example, the mold injection of resin material. The inner shape of the ink tank 100 as described later on may be defined, for example, by a metal mold (not depicted) which is pulled rearward from the opened rear surface of the ink tank 100.

The upper wall 104 defines the upper ends of the ink chambers 111 in the up-down direction 7. The lower wall 105 defines the lower ends of the ink chambers 111 in the up-down direction 7. The front wall 101 which is an exemplary upstanding wall, right wall 102, and left wall 103 are provided to stand between the upper wall 104 and the lower wall 105 in the direction intersecting with the upper wall 104 and the lower wall 105. The respective walls 101 to 105 have translucency to the extent that the inks in the ink chambers 111 can be visually confirmed from the outside of the ink tank 100.

The front wall 101 is formed of the base wall 101A and the inclined wall 101B. The base wall 101A extends from the lower wall 105 substantially in the up-down direction 7. The inclined wall 101B slopes in the up-down direction 7 and the front-rear direction 8 so as to be connected to the upper end of the base wall 101A. The inclined wall 101B includes the inlets 112 penetrating therethrough in the thickness direction of the inclined wall 101B. The inclined wall 101B is inclined rearward (i.e., toward the side of the ink chambers 111) with reference to the base wall 101A.

<Ink Chambers 111>

As depicted in FIG. 6, partition walls 107, 108, and 109 are provided in the ink tank 100 to divide the interior space of the ink tank 100. Each of the partition walls 107, 108, and 109 extends in the up-down direction 7 and the front-rear direction 8 to be connected to the front wall 101, the upper wall 104, the lower wall 105, and the film 106. Further, the partition walls 107, 108, and 109 are provided separately from each other in the left-right direction 9. Accordingly, the interior space of the ink tank 100 is divided into four ink chambers 111B, 111M, 111C, and 111Y which are adjacent to each other in the left-right direction 9. Each of the ink chambers 111 is an exemplary liquid chamber in which the ink to be discharged from the nozzles 40 is stored.

The ink chamber 111B is a space defined by the front wall 101, the right wall 102, the upper wall 104, the lower wall 105, the film 106, and the partition wall 107. The ink chamber 111M is a space defined by the front wall 101, the upper wall 104, the lower wall 105, the film 106, and the partition walls 107, 108. The ink chamber 111C is a space defined by the front wall 101, the upper wall 104, the lower wall 105, the film 106, and the partition walls 108, 109. The ink chamber 111Y is a space defined by the front wall 101, the left wall 103, the upper wall 104, the lower wall 105, the film 106, and the partition wall 109.

In the following, the ink chambers 111B, 111M, 111C, and 111Y will be collectively described as "ink chambers 111" in some cases. Further, components or parts, which are provided for the four ink chambers 111 respectively, will be expressed by using reference numerals which have the same numeral and mutually different suffixes of B, M, C, and Y. When the components or parts are described collectively, the suffixes (B, M, C, and Y) will be omitted in some cases.

Inks having mutually different colors are stored in the ink chambers 111, respectively. Specifically, a black ink is stored in the ink chamber 111B, a cyan ink is stored in the ink chamber 111C, a magenta ink is stored in the ink chamber 111M, and a yellow ink is stored in the ink chamber 111Y. Each of the color inks is an exemplary liquid. However, the number of ink chambers 111 and the colors of inks are not limited to the above examples. The ink chambers 111 are arranged in the left-right direction 9. Of the four ink chambers 111B, 111M, 111C, and 111Y, the ink chamber 111B is disposed on the rightmost side, and the ink chamber 111Y is disposed on the leftmost side. The ink chamber 111B has a capacity larger than those of other ink chambers 111M, 111C, and 111Y.

<Inlets 112>

Inlets 112B, 112M, 112C, and 112Y through which inks are poured into respective ink chambers 111 are provided in the inclined wall 101B of the ink tank 100. The inlets 112 penetrate the inclined wall 101B in its thickness direction to allow the ink chambers 111 corresponding thereto respectively to communicate with the outside of the ink tank 100. The inner surface of the inclined wall 101B faces the ink chambers 111, and the outer surface of the inclined wall 101B faces the outside of the ink tank 100. The inclined wall 101B is inclined so that the outer surface is positioned above the inner surface. Thus, the inlets 112 allow the ink chambers 111 to directly communicate with the outside of the ink tank 100. In other words, there are no bending channels having cross-sectional areas smaller than respective inlets between the inlets 112 and the ink chambers 111. Instead of the inclined wall 101B, the inlets 112 may be provided in the upper wall 104.

As depicted in FIG. 1B, the inclined wall 101B and the inlets 112 provided in the inclined wall 101B are exposed to the outside of the multifunction peripheral 10 when the cover 70 is in the exposure position. The inlets 112 are provided in the inclined wall 101B on the front side of the opening 22. In this embodiment, the posture of the ink tank 100 (the posture for pouring ink) taken when the ink(s) is(are) poured into the ink chamber(s) 111 through the inlet(s) 112 is coincident with the posture of the ink tank 100 taken when the multifunction peripheral 10 is in the usable posture. That is, the ink(s) is(are) poured into the ink chamber(s) 111 through the inlet(s) 112 when the multifunction peripheral 10 takes the usable posture. In this embodiment, each inlet 112 has a circular shape. The shape of the inlet 112, however, is not limited to this. Each inlet 112 may have an ellipsoidal shape, a polygonal shape, or the like.

The ink tank 100 includes caps 113B, 113M, 113C, and 113Y which are attachable/detachable with respect to the inlets 112 respectively. As depicted in FIG. 1A, the caps 113 attached to the inlets 112 are brought in tight contact with the peripheries of the inlets 112 to close the inlets 112. Meanwhile, as depicted in FIG. 1B, the caps 113 detached from the inlets 112 open the inlets 112. The caps 113 are attached/detached with respect to the inlets 112 in a state that the cover 70 is in the exposure position. Ink(s) can be poured into the ink chamber(s) 111 by removing the cap(s) 113 from the inlet(s) 112.

Ink flow channels (not depicted) are connected to the ink chambers 111B, 111M, 111C, and 111Y respectively. The inks stored in the ink chambers 111 flow to the outside of the ink tank 100 through the ink flow channels corresponding thereto respectively. One ends of the ink flow channels are connected to the ink chambers 111 corresponding thereto respectively, and the other ends of the ink flow channels are connected to the ink tubes 32 corresponding thereto respectively. Accordingly, the inks stored in the ink chambers 111 are supplied to the recording head 39 via the ink flow channels and ink tubes 32 corresponding thereto respectively.

Atmosphere communication holes (not depicted) are provided in the ink chambers 111B, 111M, 111C, and 111Y respectively. The atmosphere communication holes allow the ink chambers 111 corresponding thereto respectively to communicate with the atmosphere. This keeps the internal pressure of each of the ink chambers 111 at atmospheric pressure, and thereby preventing the excessive supply of the ink due to the increase in internal pressure of each of the ink chambers 111, the backflow of the ink due to the decrease in internal pressure of each of the ink chambers 111, and the like. Semipermeable films or the like are affixed to the atmosphere communication holes so as to prevent the inks from leaking.

<Cover 70>

As described above, the cover 70 is in the box shape including the main wall 72, the side walls 73, 74, and 75, and the protruding wall 86. The side wall 73 extends along the outer edge of the main wall 72 on the pivot front-end side of the cover 70. The side wall 74 extends, along the outer edge of the main wall 72, from one end of the side wall 73 in the left-right direction 9. The side wall 75 extends, along the outer edge of the main wall 72, from the other end of the side wall 73 in the left-right direction 9. That is, the side walls 74, 75 are provided to face each other in the left-right direction 9. The protruding wall 86 extends in the left-right direction 9. Side walls 87 are formed, as a pair, on both ends of the protruding wall 86 in the left-right direction 9. The side walls 87 project in the thickness direction of the main wall 72. The outer surface of the cover 70 (i.e., the outer surfaces of the main wall 72, side walls 73 to 75, protruding wall 86, and side wall 87) continues to the outer surface of the casing 14 of the multifunction peripheral 10. That is, the outer surface of the cover 70 constitutes a part of the outer surface of the casing 14 of the multifunction peripheral 10.

The cover 70 include a transparent portion 76. A user can visually check the front wall 101 of the ink tank 100 from the outside of the multifunction peripheral 10 through the transparent portion 76 in a state that the cover 70 is in the covering position. The transparent portion 76 includes an opening 77 and a film 78. The opening 77 is substantially rectangular and penetrates the main wall 72 in the thickness direction. The film 78 closes the opening 77.

As depicted in FIG. 8, the opening 77 is provided in a position where the opening 77 faces the front wall 101 of the ink tank 100 in a state that the cover 70 is in the covering position. The film 78 is made of light transmissive material. In this embodiment, the film 78 is affixed to the circumferential edge of the opening 77 on the side of the outer surface of the main wall 72 (i.e., the surface opposite to the inner surface, of the cover 70, facing the front wall 101).

As depicted in FIGS. 7A to 9, the protruding wall 86 includes an engaging part 50. The engaging part 50 includes a deformable part 81 and an engaging claw 82. The deformable part 81 protrudes from the inner surface of the protruding wall 86 (i.e., the surface on the same side as the surface, of the cover 70 in the covering position, facing the front wall 101) in the same protruding direction as the side walls 73, 74, and 75. The engaging claw 82 is formed at the protruding end of the deformable part 81. The engaging part 50 is provided on the side closer to the pivot front-end of the cover 70 than the opening 77. The engaging part 50 is provided in the center of the cover 70 in the left-right direction 9. The deformable part 81 is made of resin. The deformable part 81 has a flat plate shape extending in the left-right direction 9 and the front-rear direction 8. The deformable part 81 is elastically deformable in the direction orthogonal to the rotation axis 71 of the cover 70, depending on external force, with the base end on the side of the protruding wall 86 as the center.

As depicted in FIG. 8, when the cover 70 is in the covering position, the engaging part 50 is fitting in the recess 30. In other words, the recess 30 can receive the engaging part 50 of the cover 70 in the covering position.

Figure 9:
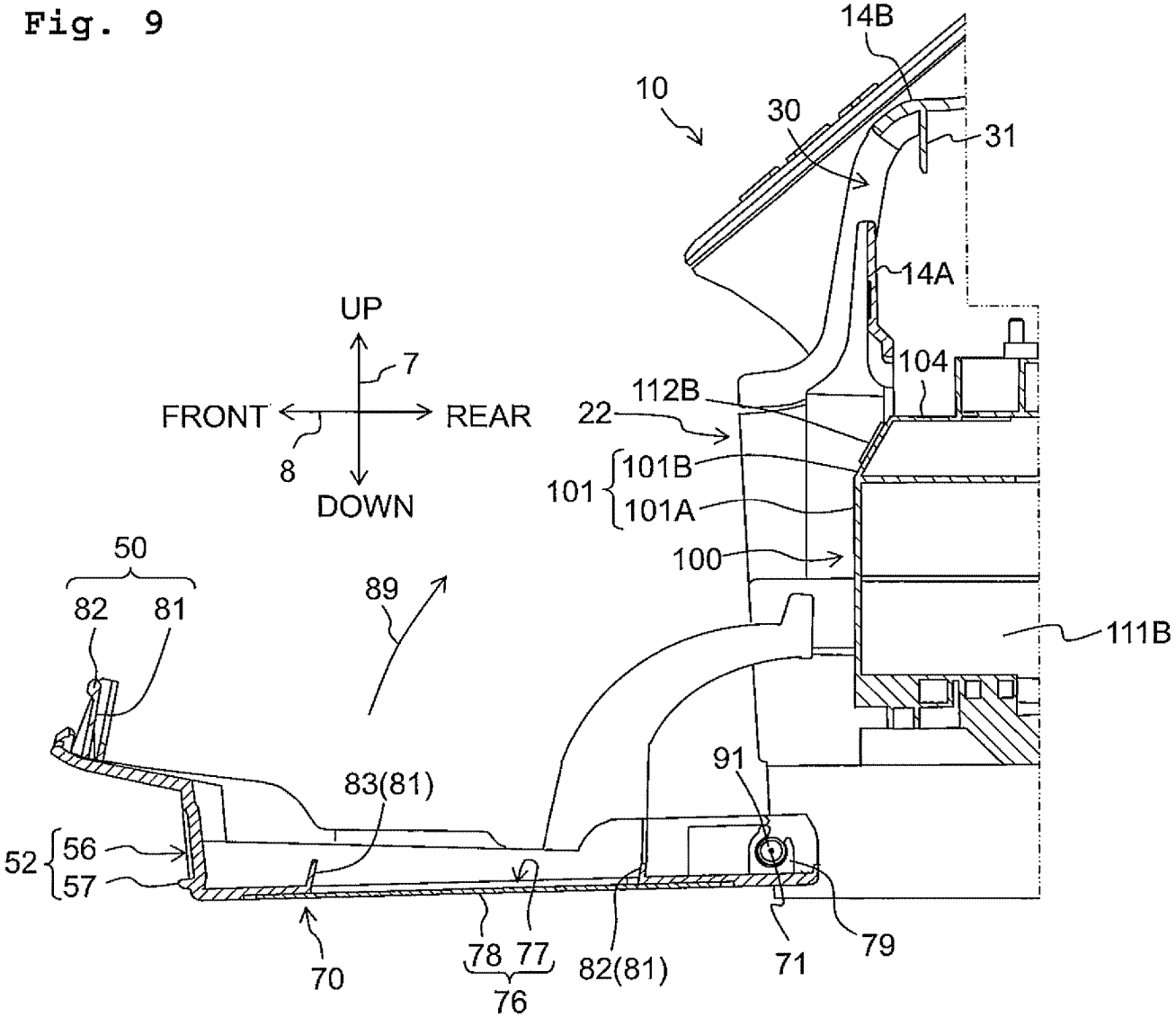
FIG. 9 is a vertical cross-sectional view of the ink tank and the cover in an exposure position.

Here, as depicted in FIG. 9, the lower side of the recess 30 is defined by the front wall 14A of the casing 14. The upper side of the recess 30 is defined by the upper wall 14B of the casing 14. Further, the upper side of the recess 30 is defined by, in addition to the upper wall 14B, a rib 31. The rib 31 extends downward from the upper wall 14B, on the rear side of a part, of the upper wall 14B, defining the upper side of the recess 30. That is, the upper front side of the recess 30 is defined by the upper wall 14B, and the upper rear side of the recess 30 is defined by the rib 31.

The engaging claw 82 projects from the protruding end of the deformable part 81 in the direction away from the rotation axis 71 and extends in the left-right direction 9. The engaging claw 82 engages with the rib 31 in a state that the cover 70 is in the covering position. In other words, the rib 31 engages with the engaging part 50 fitting in the recess 30. As described above, the rib 31 defines the upper rear side of the recess 30. Thus, the rib 31 constitutes the periphery of the recess 30. That is, the engaging part 50 engages with the periphery of the recess 30 in the state that the cover 70 is in the covering position. This holds the cover 70 in the covering position.

As depicted in FIGS. 7A to 9, the cover 70 includes a tab 52. A user releases the engagement between the recess 30 and the engaging part 50 by means of the tab 52. That is, the tab 52 is subjected to the operation for releasing the engagement between the recess 30 and the engaging part 50. The tab 52 is formed in the side wall 73 on the pivot front-end side of the cover 70. The tab 52 is provided on the side closer to the pivot front-end of the cover 70 than the opening 77. The tab 52 is provided in the side wall 73 on the side closer to the main wall 72 in the front-rear direction 8.

In this embodiment, the tab 52 includes a recess 56 and a protrusion 57. The recess 56 is formed so that the outer surface of the side wall 73 is recessed toward the inner surface of the side wall 73. The protrusion 57 protrudes, in the direction away from the rotation axis 71, from the end, of the recess 56, on the side closer to the main wall 72 in the front-rear direction 8. A user inserts his/her finger into the recess 56, when operating the tab 52. The protrusion 57 extends in the left-right direction 9. The length of the protrusion 57 in the left-right direction 9 is longer than that of the engaging claw 82 of the engaging part 50. The position of the protrusion 57 is closer to the left side of the cover 70 than the position of the engaging part 50, as will be described later on (see FIG. 7A). The engaging claw 82 of the engaging part 50 and the protrusion 57 intersect with a virtual plane 53 orthogonal to the left-right direction 9. The protrusion 57 is caught by the finger of the user which is being inserted into the recess 56. The tab 52 may have any structure instead of the above structure, provided that the user can perform the operation for releasing the engagement between the recess 30 and the engaging part 50 by means of the tab 52.

Figure 10A:
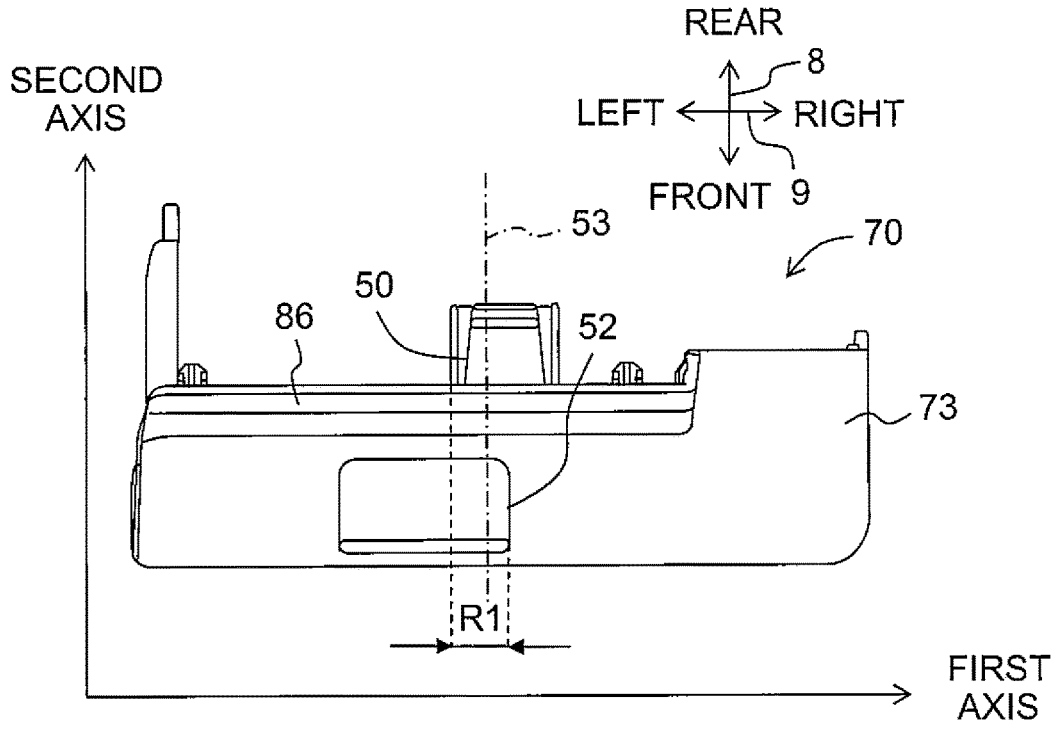

The engaging part 50 and the tab 52 have the positional relation as described below. That is, as depicted in FIGS. 2A, 7A, and 10A, the engaging part 50 and the tab 52 intersect with the virtual plane 53, which is orthogonal to the left-right direction 9. In other words, the engaging part 50 and the tab 52 are partially in the same position in the left-right direction 9. That is, the engaging part 50 and the tab 52 are disposed to partially overlap with each other as viewed from the front-rear direction 8.

In the following, the positional relation between the engaging part 50 and the tab 52 in a state that the cover 70 is in the covering position will be explained in more detail while referring to FIG. 10A. When a first axis extends in the left-right direction 9 and a second axis extends in the front-rear direction 8, the engaging part 50 and the tab 52 partially overlap with each other in the first axis direction. That is, the engaging part 50 overlaps with the tab 52 in a range R1. Meanwhile, the engaging part 50 is positioned on the rear side of the tab 52 in the front-rear direction 8. Thus, the engaging part 50 does not overlap with the tab 52 in the second axis direction.

In this embodiment, as depicted in FIGS. 2A and 10A, the tab 52 is longer than the engaging part 50 in the left-right direction 9. The tab 52, however, may be shorter than the engaging part 50 in the left-right direction 9, or may have the same length as that of the engaging part 50 in the left-right direction 9.

In this embodiment, as depicted in FIG. 10A, the right end of the tab 52 is on the left side of the right end of the engaging part 50, and the left end of the tab 52 is on the left side of the left end of the engaging part 50. The positional relation between the tab 52 and the engaging part 50 in the left-right direction 9, however, is not limited to the above positional relation.

Figure 10B:
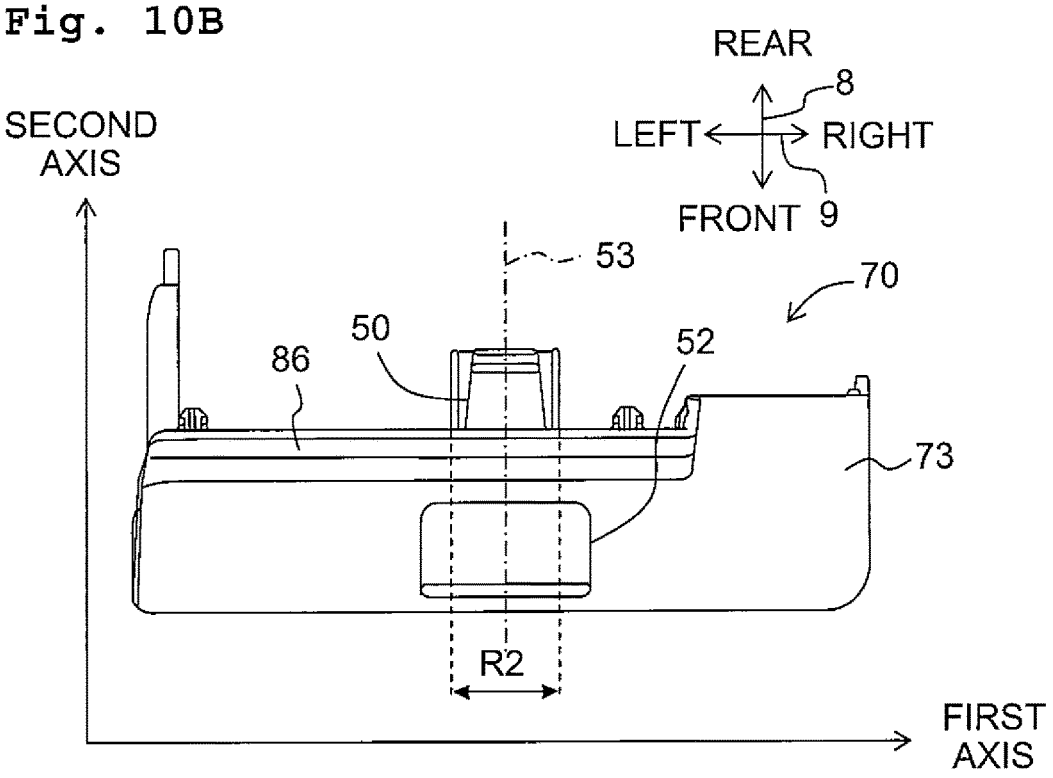

For example, as depicted in FIG. 10B, the tab 52 may be provided in the central portion of the cover 70 in the left-right direction 9 in a similar manner as the engaging part 50. In this case, the right end of the tab 52 is on the right side of the right end of the engaging part 50, and the left end of the tab 52 is on the left side of the left end of the engaging part 50. That is, when the first axis and the second axis in FIG. 10B extend in the same directions as those of FIG. 10A respectively, the entire engaging part 50 overlaps with a part of the tab 52 in the first axis direction. Thus, the engaging part 50 overlaps with the tab 52 in a range R2. In this case, the central portions of the tab 52 and the engaging part 50 in the left-right direction 9 are disposed on the same virtual plane 53. Or, contrary to the above, the entire tab 52 may overlap with a part of the engaging part 50 in the first axis direction.

Alternatively, the right end of the tab 52 and the right end of the engaging part 50 may be disposed on the same position in the left-right direction 9, and the left end of the tab 52 and the left end of the engaging part 50 may be disposed in the same position in the left-right direction 9. That is, the entire engaging part 50 may overlap with the entire tab 52 in the first axis direction.

Summarizing the above, when the first axis extends in the left-right direction 9 and the second axis extends in the front-rear direction 8, the engaging part 50 overlaps at least partially with the tab 52 in the first axis direction.

<Rotating Operation of Cover 70>

When a user pushes the tab 52 toward the rotation axis 71 in a state that the cover 70 is in the covering position as depicted in FIG. 8, the side wall 73 is bent due to elastic deformation so as to move toward the rotation axis 71. Accompanying with the movement of the side wall 73 toward the rotation axis 71, the protruding wall 86 projecting from the side wall 73 and the deformable part 81 of the engaging part 50 formed in the protruding wall 86 also move toward the rotation axis 71. This releases the engagement between the engaging claw 82 and the recess 30 (rib 31). In this situation, when the user moves the cover 70 rotationally in the direction indicated by an arrow 88 which is the direction away from the ink tank 100, the cover 70 moves from the covering position depicted in FIG. 8 to the exposure position depicted in FIG. 9.

When the user moves the cover 70 in the exposure position depicted in FIG. 9 rotationally in the direction indicated by an arrow 89 which is opposite to the direction indicated by the arrow 88, the engaging part 50 approaches the recess 30. When the user further moves the cover 70 rotationally in the direction indicated by the arrow 89, the engaging claw 82 of the engaging part 50 makes contact with the rib 31. In this situation, when the cover 70 is subjected to the force in the direction indicated by the arrow 89, the deformable part 81 of the engaging part 50 is bent due to elastic deformation so as to move toward the rotation axis 71. This causes the engaging claw 82 to ride over the rib 31, so that the engaging claw 82 engages with the rib 31 (see FIG. 8). Accordingly, the cover 70 covers the front wall 101 of the ink tank 100 from the front side. That is, the cover 70 depicted in FIG. 8 is in the covering position.

[Action and Effect]

In the above embodiment, the engaging part 50 and the tab 52 are positioned to intersect with the same virtual plane 53. Thus, most of the pressing force applied to the tab 52 is applied, as it is, to the engaging part 50. This can reduce the twisting of the cover 70, which is caused by the force applied to the tab 52 by the user. As a result, the cover 70 can be smoothly moved rotationally between the covering position and the exposure position. The opening 77 provided in the cover 70 may be open or closed with a transparent member.

In the above embodiment, the engaging part 50 and the tab 52 are disposed in the central part of the cover 70 in the left-right direction 9 on the side closer to the pivot front-end of the cover 70 than the opening 77. This can reduce the force required to release the engagement between the engaging part 50 and the recess 30, and thereby making it possible to further reduce the twisting of the cover 70.

In the above embodiment, the cover 70 includes the side walls 73, 74, and 75. Thus, the side walls 73, 74, and 75 can compensate for the reduction of rigidity owing to the structure in which the cover 70 is formed with the opening 77. The side walls 73, 74, and 75, however, may not be provided over the entire area of the outer periphery of the main wall 72. The side walls 73, 74, and 75 may be provided at only parts of the outer periphery of the main wall 72.

In the above embodiment, when the tab 52 is pushed to elastically deform the cover 70, the engagement between the engaging part 50 and the recess 30 is released. The cover 70 formed with the opening 77 is elastically deformed easily, and thus it is possible to further reduce the force required to release the engagement between the engaging part 50 and the recess 30.

Modified Embodiment 1

In the above embodiment, the recess 30 corresponds to the engaging target part. Further, in the above embodiment, the engaging part 50 protrudes from the inner surface of the protruding wall 86 in the same protruding direction as the side walls 73, 74, and 75. The engaging target part, however, is not limited to the recess 30 provided that the engaging target part is engageable with the engaging part to hold the cover 70 in the covering position. Further, the shape of the engaging part is not limited to the protruding shape provided that the engaging part is engageable with the engaging target part.

For example, unlike the above embodiment, the target engaging part may protrude frontward from the front surface of the casing 14, and the engaging part may be a recess formed in the inner surface of the protruding wall 86.

Modified Embodiment 2

In the above embodiment, the engaging part 50 is provided in the protruding wall 86. The engaging part 50, however, may be provided in any part other than the protruding wall 86, provided that the engaging part 50 engages with the recess 30. For example, the engaging part 50 may be provided in the side wall 73.

Modified Embodiment 3

In the above embodiment, the left-right direction 9 corresponds to the further direction. That is, the cover 70 is rotatable, between the covering position where the front wall 101 is covered with the cover 70 and the exposure position where the front wall 101 is exposed, around the rotation axis 71 extending in the left-right direction 9. In other words, the cover 70 is configured to cover the opening 22 formed in the front surface of the casing 14 from the front side.

The further direction, however, is not limited to the left-right direction 9. For example, the front-rear direction 8 may be the further direction. In this case, the cover 70 is rotatable, between the covering position where the right wall 102 or the left wall 103 is covered with the cover 70 and the exposure position where the right wall 102 or the left wall 103 is exposed, around the rotation axis extending in the front-rear direction 8. In other words, the cover 70 is configured to cover the opening formed in the right surface or the left surface of the casing 14 from the right side or the left side.

Modified Embodiment 4

In the above embodiment, the engaging part 50 and the tab 52 are provided in the central portion of the cover 70 in the left-right direction 9 on the side closer to the pivot front-end of the cover 70 than the opening 77. The engaging part 50 and the tab 52, however, may be disposed in any position other than the above, provided that the engaging part 50 and the tab 52 intersect with the same virtual plane orthogonal to the left-right direction 9. For example, the engaging part 50 and the tab 52 may be provided on the side closer to the pivot base-end of the cover 70 than the opening 77. Alternatively, the engaging part 50 and the tab 52 may be provided on the right side or the left side from the central portion of the cover 70 in the left-right direction 9.

What is claimed is:

1. A liquid-consuming apparatus, comprising:

a tank including a liquid chamber, an upstanding wall facing a particular direction, and the upstanding wall defining the liquid chamber and being configured to allow liquid in the liquid chamber to be visually confirmed from an outside;

a liquid-consuming unit configured to consume the liquid stored in the liquid chamber;

a cover configured to rotate between a covering position where the upstanding wall is covered with the cover and an exposure position where the upstanding wall is exposed, around a rotation axis extending in a further direction, wherein the cover includes a transparent portion and a main wall that is parallel to the upstanding wall when in the covering position; and a casing including an engaging target part and configured to support the tank, the liquid-consuming unit, and the cover, the engaging target part being configured to hold the cover in the covering position, wherein the cover includes an engaging part and a tab, the engaging part being configured to engage with the engaging target part in a state that the cover is in the covering position, the tab being subjected to an operation of releasing an engagement between the engaging part and the engaging target part, the engaging part and the tab are arranged to intersect with an identical virtual plane orthogonal to the further direction, the engaging part and the tab are arranged in a central portion of the cover in the further direction, and the transparent portion is arranged further in the particular direction than the engaging part and the tab in the state that the cover is in the covering position.

2. The liquid-consuming apparatus according to claim 1, wherein the cover includes the main wall and a side wall, the main wall being formed with the transparent portion, the side wall protruding from the main wall in an opposite direction to the particular direction in the state that the cover is in the closing position, and the tab is provided in the side wall.

3. The liquid-consuming apparatus according to claim 2, wherein the cover includes a protruding wall protruding from the side wall in a direction away from the rotation axis and being formed with the engaging part, the engaging target part is a recess configured to receive the engaging part in the state that the cover is in the covering position, the engaging part is configured to engage with a periphery of the recess in the state that the cover is in the covering position, and the engagement between the engaging part and the engaging target part is released by an operation in which the tab is pushed toward the rotation axis.

4. The liquid-consuming apparatus according to claim 3, wherein the engaging part includes a deformable part and a projection, the deformable part protruding from the protruding wall, the projection being formed at a protruding end of the deformable part and being configured to engage with the recess in the state the cover is in the covering position.

5. The liquid-consuming apparatus according to claim 4, wherein the tab includes a protrusion protruding from the side wall, and a direction in which the deformable part protrudes from the protruding wall intersects with a direction in which the protrusion protrudes from the side wall.

6. The liquid-consuming apparatus according to claim 3, wherein the engagement between the engaging part and the engaging target part is released by rotating the cover around the rotation axis.

7. The liquid-consuming apparatus according to claim 1, wherein the further direction is a direction intersecting with the vertical direction, and the rotation axis extends in the further direction at a lower end of the cover in the state that the cover is in the covering position.

8. The liquid-consuming apparatus according to claim 1, wherein the tab is longer than the engaging part in the further direction.

9. The liquid-consuming apparatus according to claim 1, wherein a central portion of the tab in the further direction does not overlap with, in the particular direction, a central portion of the engaging part in the further direction.

10. The liquid-consuming apparatus according to claim 1, wherein a central portion of the tab in the further direction and a central portion of the engaging part in the further direction are arranged on the same virtual plane.

11. The liquid-consuming apparatus according to claim 1, wherein the cover is made of resin.

* * * * *